US007704088B2

(12) United States Patent
Sakamoto

(10) Patent No.: US 7,704,088 B2
(45) Date of Patent: Apr. 27, 2010

(54) CIRCUIT BOARD CONNECTOR

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/425,105

(22) Filed: Apr. 16, 2009

(65) Prior Publication Data

US 2009/0264019 A1 Oct. 22, 2009

(30) Foreign Application Priority Data

Apr. 21, 2008 (JP) ..... 2008-109756

(51) Int. Cl.
*H01R 13/64* (2006.01)

(52) U.S. Cl. ..... 439/246; 439/474

(58) Field of Classification Search ..... 439/246, 439/474, 79

See application file for complete search history.

(56) References Cited

U.S. PATENT DOCUMENTS 4,810,215 A * 3/1989 Kaneko ..... 439/845
5,112,235 A * 5/1992 Enomoto et al. ..... 439/83
6,155,856 A * 12/2000 Sanada ..... 439/246
6,997,727 B1 * 2/2006 Legrady et al. ..... 439/246
6,997,737 B2 * 2/2006 Hiwatashi ..... 439/474
2005/0048824 A1 * 3/2005 Horikoshi et al. ..... 439/246
2006/0068620 A1 3/2006 Okamura
2008/0132096 A1 * 6/2008 Yamagami ..... 439/79

FOREIGN PATENT DOCUMENTS

JP 2005-116230 A 4/2005
JP 2006-100231 A 4/2006

* cited by examiner

*Primary Examiner*—Gary F. Paumen
(74) *Attorney, Agent, or Firm*—Sughrue Mion, PLLC

(57) ABSTRACT

A circuit board connector is provided. The circuit board connector includes: a connector housing which is mounted on a circuit board; and a terminal which is press-fitted into the terminal press-fitting hole of the connector housing. The terminal includes: a terminal connecting portion which is disposed through the rear side of the connector housing to be connected to a mating connector; a press-fitting portion to be fixed to the connector housing; a board fixing portion fixed to the circuit board by soldering; and a coupling portion extending and bent toward a side of the circuit board to couple the press-fitting portion with the board fixing portion. The circuit board connector also includes a stress absorbing portion provided with a center hole which is provided on a midway of the coupling portion so as to absorb a stress by being deformed.

4 Claims, 9 Drawing Sheets

PRIOR ART

CIRCUIT BOARD CONNECTOR

BACKGROUND OF THE INVENTION

1. Technical Field

The present invention relates to a circuit board connector which is mounted on a circuit board.

2. Background Art

Examples of this type of circuit board connector are shown in, for example, JP-A-2006-100231 and JP-A-2005-116230. FIG. 8 is a schematic diagram of a circuit board connector described in JP-A-2006-100231. FIGS. 9A and 9B are schematic diagrams of terminals of the connector.

As shown in FIG. 8, the circuit board connector is comprised of a resin-made connector housing 101 having in its front portion a fitting port 102 for fitting to a mating connector, as well as a multiplicity of metallic terminals 110A and 110B which are press-fitted from the rear side into terminal press-fitting holes 104 in a rear wall 103 of the connector housing 101 and are fixed therein.

Of the two kinds of terminals 110A and 110B, the terminal 110A shown in FIG. 9A is press-fitted into the terminal press-fitting hole 104 in the upper stage of the connector housing 101, while the terminal 110B shown in FIG. 9B is press-fitted into the terminal press-fitting hole 104 in the lower stage of the connector housing 101.

Each of the terminals 110A and 110B has at its front end a terminal connecting portion 111 which is disposed through the rear wall 103 of the connector housing 101 and extends therefrom toward the front side so as to be connected to the terminal on the mating connector side. Further, in the rear of the terminal connecting portion 111, each of the terminals 110A and 110B has a press-fitting portion 112 which is fixed to the connector housing 101 by being press-fitted in the terminal press-fitting hole 104. Furthermore, in the rear of the press-fitting portion 112, each of the terminals 110A and 110B has a board fixing portion 117 which is fixed to a circuit board by soldering through a connecting portion 119 which extends by being bent toward the circuit board side.

With this type of circuit board connector, there has been a problem in that since the terminals 110A and 110B are press-fitted into and fixed in the connector housing 101, in a case where a thermal contraction difference has occurred between the circuit board and the connector housing owing to a thermal cycle or the like, stresses are undesirably generated in the terminals 110A and 110B, possibly inducing cracks in the portions of the board fixing portions 117 which are soldered to the circuit board.

SUMMARY OF THE INVENTION

In view of the above-described circumstances, an object of the invention is to provide a circuit board connector which, even in a case where a thermal contraction difference occurs between the circuit board and the connector housing owing to a thermal cycle or the like, is capable of alleviating stresses occurring in the terminals and of ensuring that cracks are not be formed in the portions of the terminals which are soldered to the circuit board.

To attain the above object, in accordance with a first aspect of the invention there is provided a circuit board connector, which includes: a connector housing which is mounted on a circuit board and is provided with a fitting port for fitting a mating connector at a front side and a terminal press-fitting hole at a rear side; and a terminal which is press-fitted into and fixed to the terminal press-fitting hole and which includes: a terminal connecting portion which is disposed through the rear side of the connector housing and extends therefrom toward the front side so as to be connected to a terminal of the mating connector; a press-fitting portion which is continuous from the terminal connecting portion to be fixed to the connector housing by being press-fitted in the terminal press-fitting hole; a board fixing portion which is fixed to the circuit board by soldering; and a coupling portion which extends and is bent toward a side of the circuit board to couple the press-fitting portion with the board fixing portion, and a stress absorbing portion provided with a center hole which is provided on a midway of the coupling portion so as to absorb a stress by being deformed.

In accordance with a second aspect of the invention, in the circuit board connector according to the first aspect of the invention, the coupling portion includes: a first straight portion extending linearly on an extension of the terminal connecting portion and the press-fitting portion; a first bent portion bent from a rear end of the first straight portion toward the side of the circuit board; a second straight portion extending linearly from the first bent portion toward the circuit board; and a second bent portion bent from a lower end of the second straight portion in a direction toward the front side or a direction toward the rear side parallel to the circuit board, the board fixing portion being provided on an extension of the second bent portion, and the stress absorbing portion is formed of a square frame shape, and is provided midway in the first straight portion such that a penetrating direction of the center hole is directed in a vertical direction, first opposing two sides thereof are oriented substantially parallel to a front-back direction, and remaining second opposing two sides thereof are oriented substantially parallel to a left-right direction.

In accordance with a third aspect of the invention, in the circuit board connector according to the first aspect of the invention, an accommodating portion for accommodating the stress absorbing portion is provided in the rear of the terminal press-fitting hole of the connector housing, such that a clearance is provided between the accommodating portion and the stress absorbing portion.

In accordance with a fourth aspect of the invention, in the circuit board connector according to the second aspect of the invention, an inner or outer width between the second opposing two sides of the stress absorbing portion is made greater than a width of the first straight portion.

According to the above-described first aspect of the invention, the stress absorbing portion is provided in the rear of the press-fitting portion of the terminal, i.e., midway in the coupling portion coupling the press-fitting portion with the board fixing portion. Therefore, even in a case where a stress has occurred between the press-fitting portion and the board fixing portion owing to such as a thermal contraction difference between the connector housing and the circuit board, it is possible to absorb the stress as the stress absorbing portion is deformed. Accordingly, an undue stress ceases to be applied to a portion of the board fixing portion which is soldered to the circuit board, and it is thereby possible to prevent in advance a crack from being formed in the soldered portion and enhance the connection reliability of the soldered portion.

According to the above-described second aspect of the invention, since the square frame-shaped stress absorbing portion is deformed diagonally while maintaining the opposing two sides substantially parallel to each other, it is possible to absorb the positional offset in the left-right direction between the press-fitting portion and the board fixing portion of the terminal.

According to the above-described third aspect of the invention, since the accommodating portion for accommodating the stress absorbing portion is provided in the rear of the terminal press-fitting hole of the connector housing, and a clearance is provided between the accommodating portion and the stress absorbing portion, the stress absorbing portion can be freely deformed within the accommodating portion.

According to the above-described fourth aspect of the invention, since the inner or outer width between the second opposing two sides of the stress absorbing portion is made greater than a width of the first straight portion, the opposing two sides in the left-right direction can be easily deformed to absorb the stress.

DETAILED DESCRIPTION OF THE PREFERRED EMBODIMENTS

Referring now to the accompanying drawings, a description will be given of an embodiment of the invention.

Figure 1:
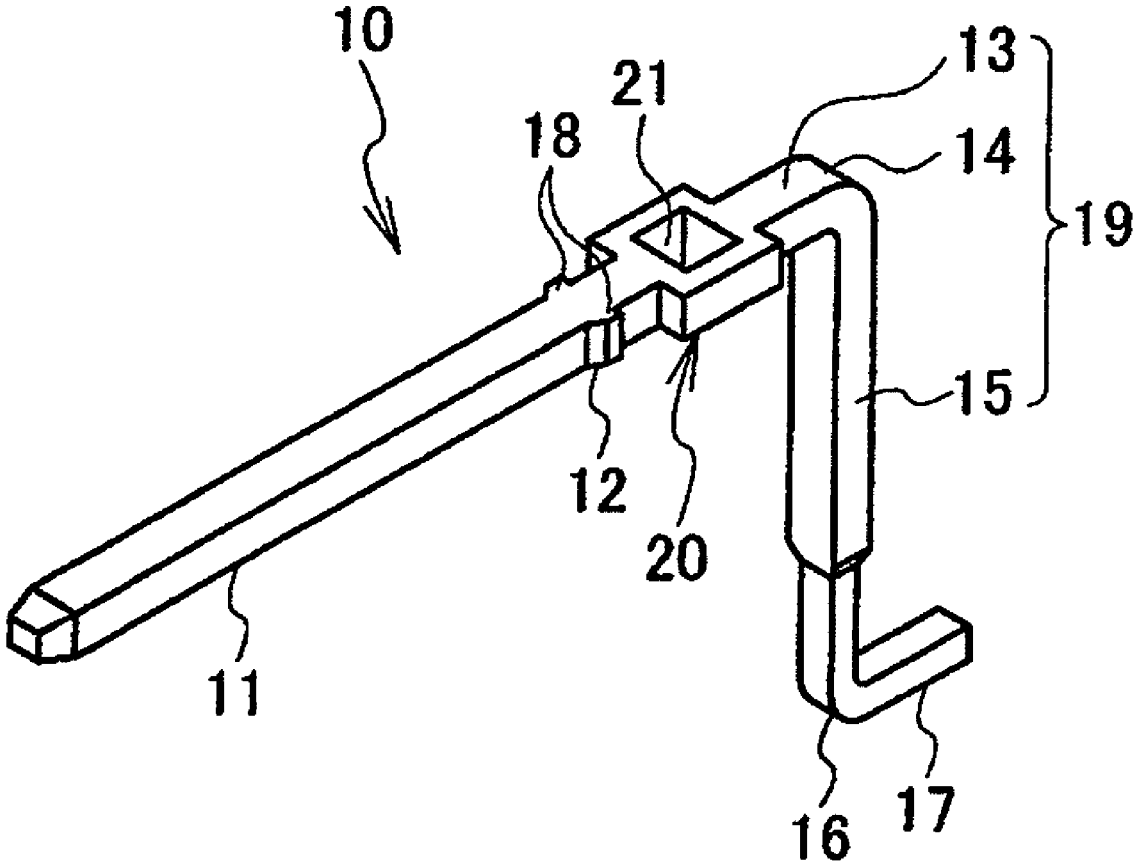
FIG. 1 is a perspective view illustrating the construction of a terminal which is used in the circuit board connector in accordance with the embodiment.
Figure 2:
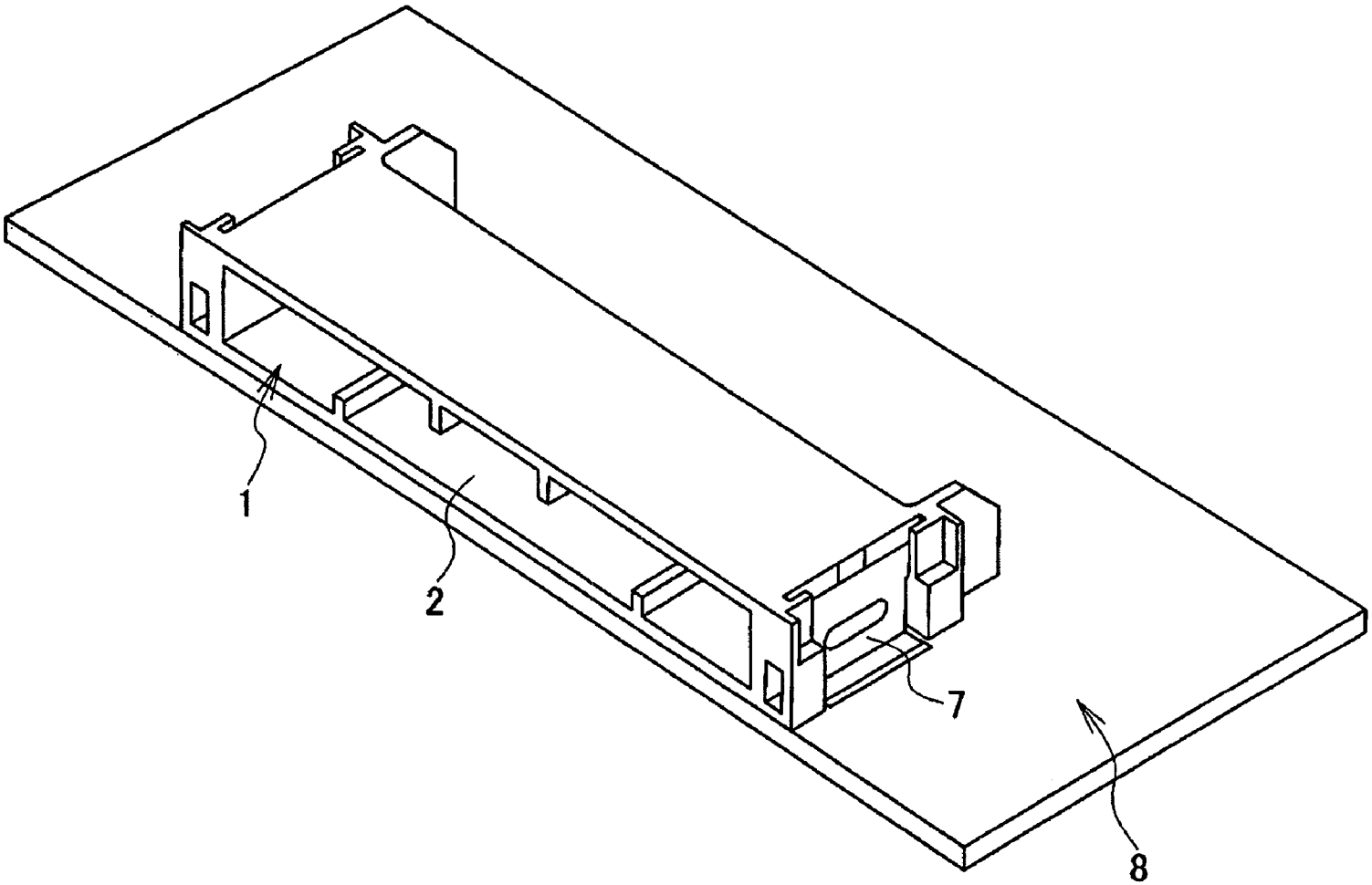
FIG. 2 is an external perspective view taken from the front side of the circuit board connector in accordance with the embodiment.
Figure 3:
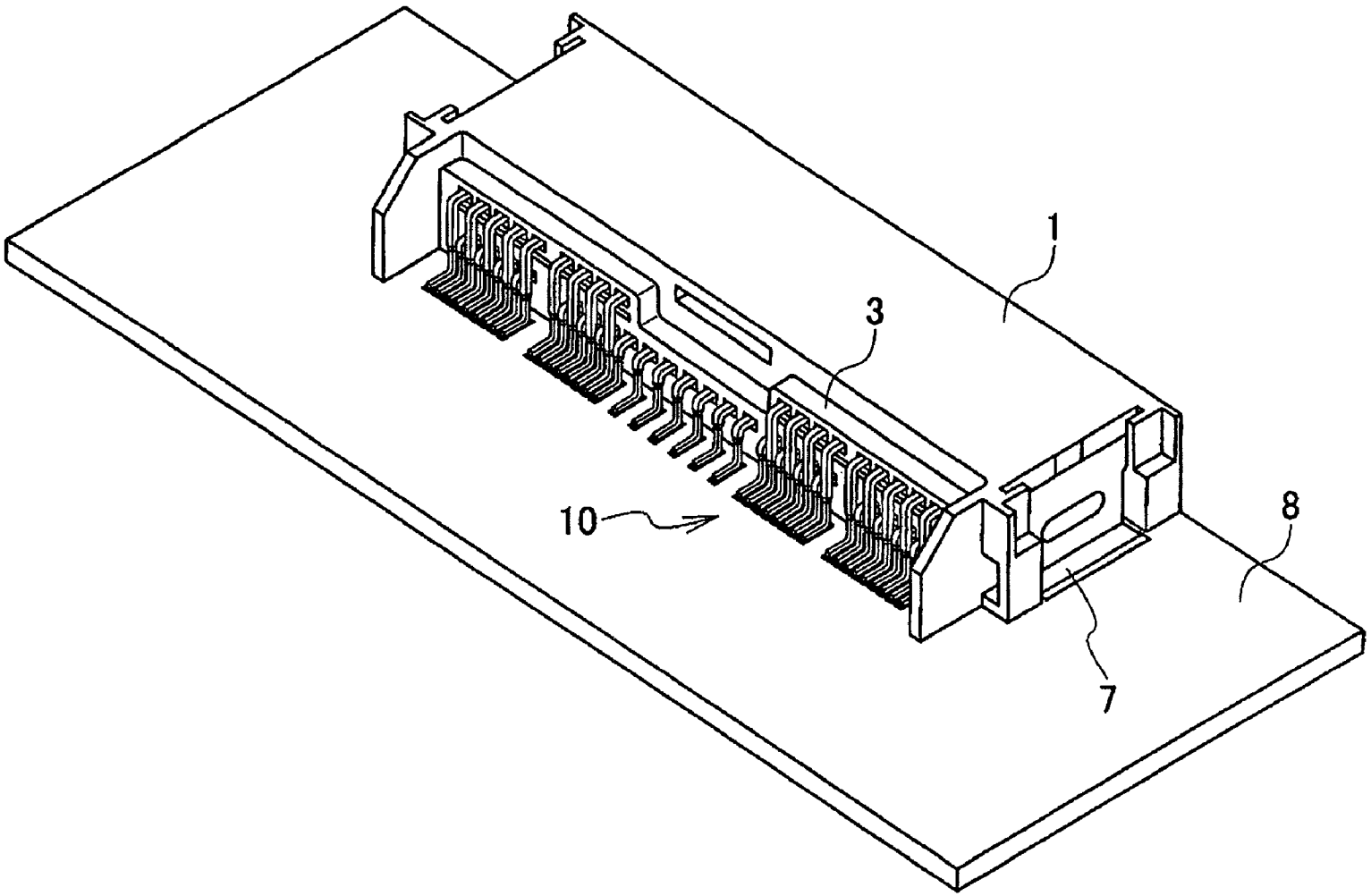
FIG. 3 is an external perspective view taken from the rear side of that circuit board connector.
Figure 4:
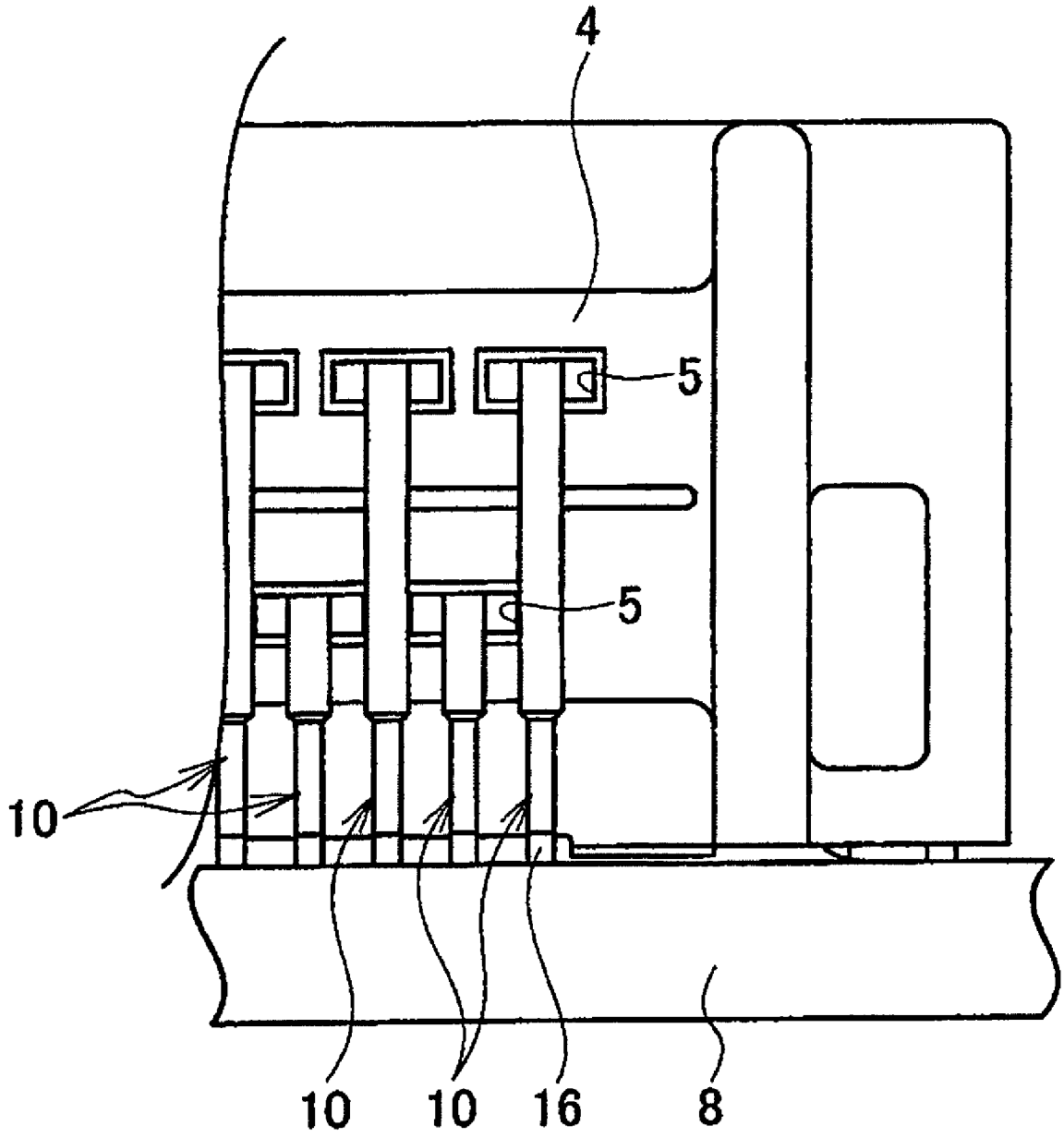
FIG. 4 is a rear view of essential portions of the circuit board connector.
Figure 5:
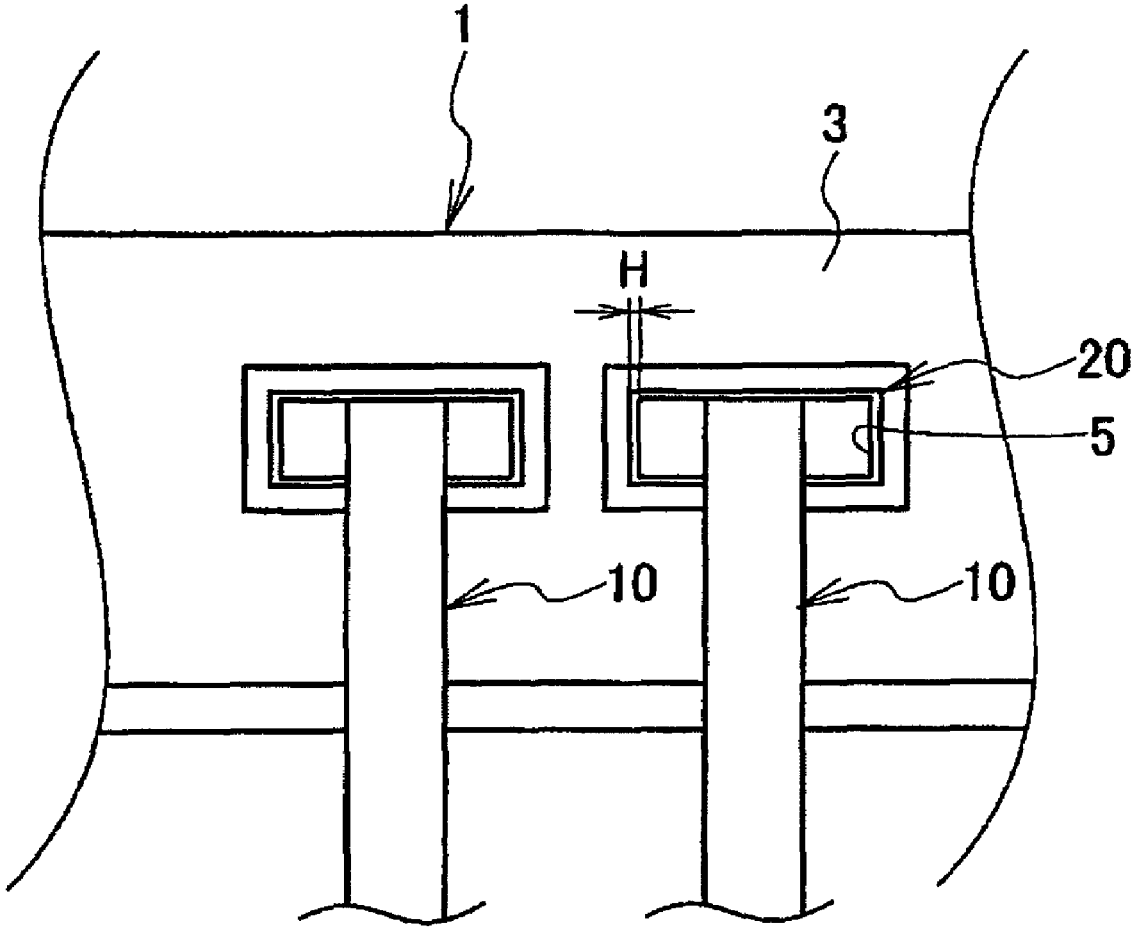
FIG. 5 is a partial enlarged view thereof.
Figure 6:
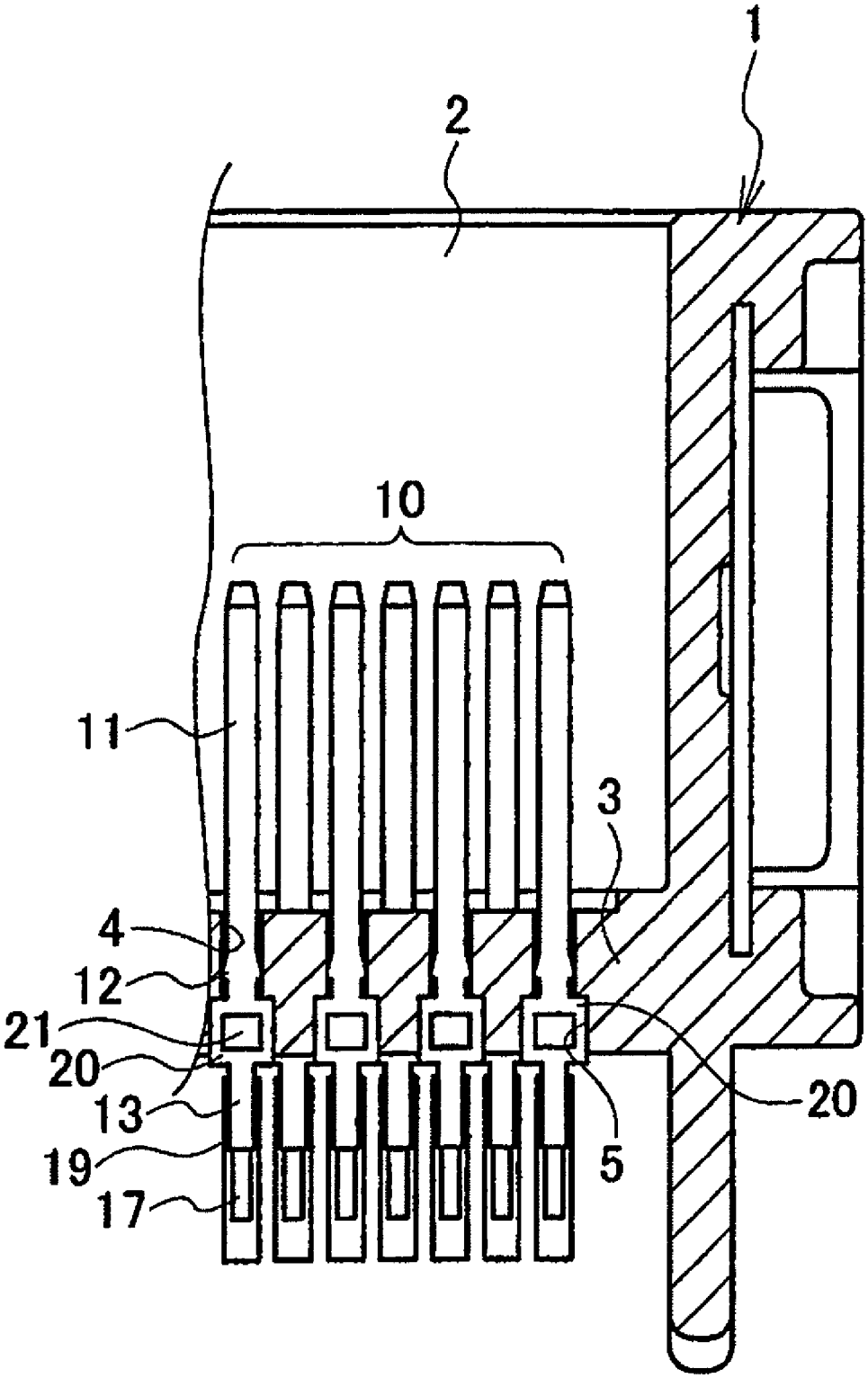
FIG. 6 is a horizontal cross-sectional view of that circuit board connector.
Figure 7:
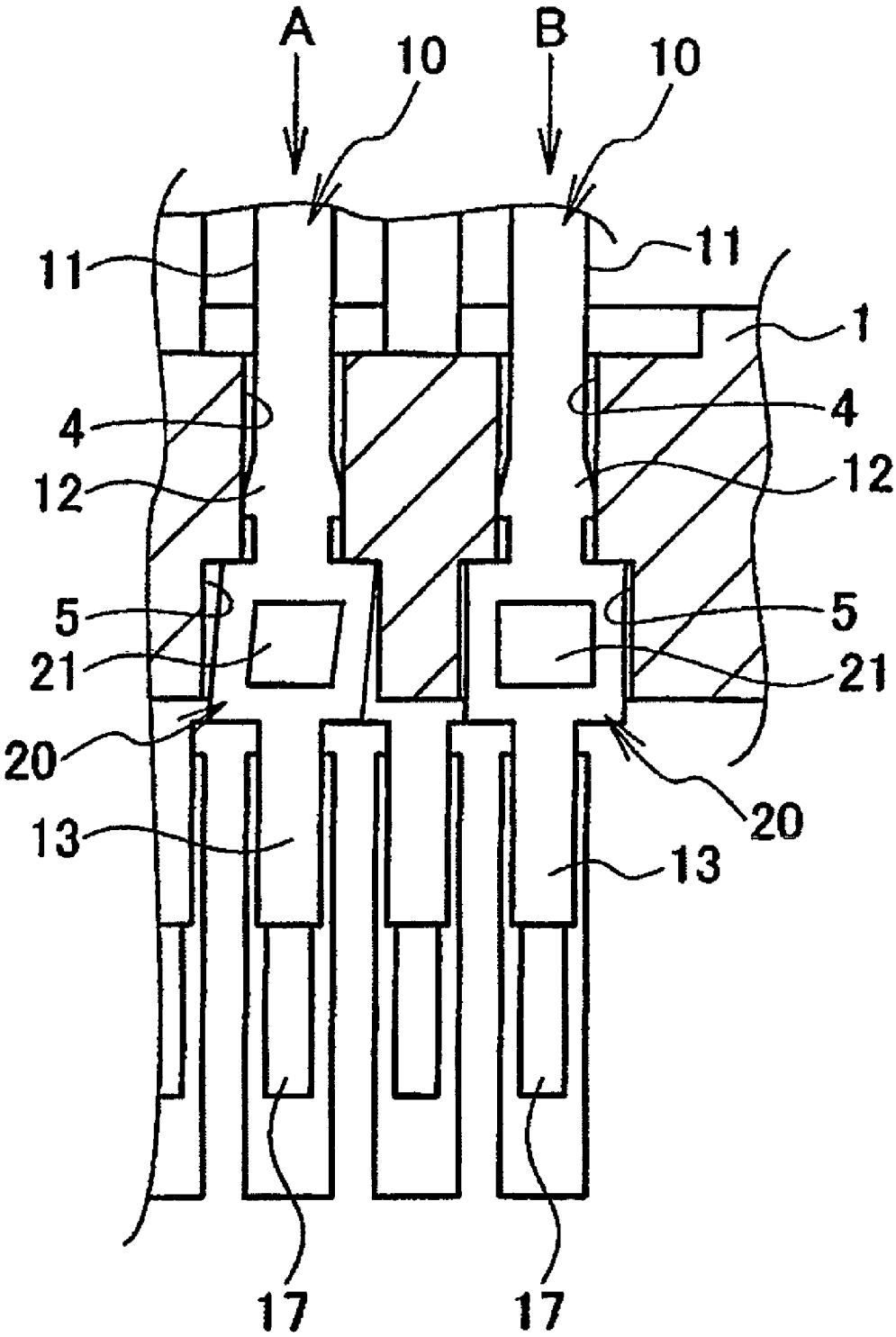
FIG. 7 is a partial enlarged view thereof.
Figure 8:
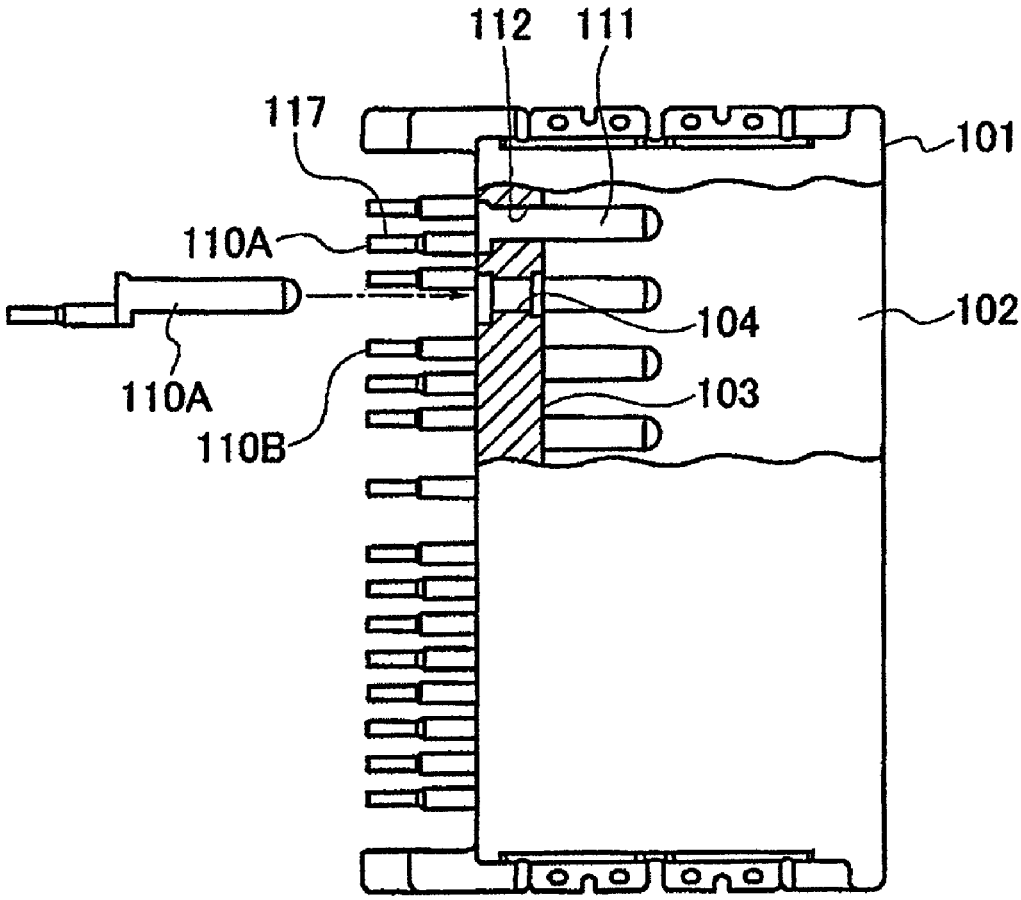
PRIOR ART FIG. 8
FIG. 8 is a horizontal cross-sectional view of a conventional circuit board connector.
Figure 9A:
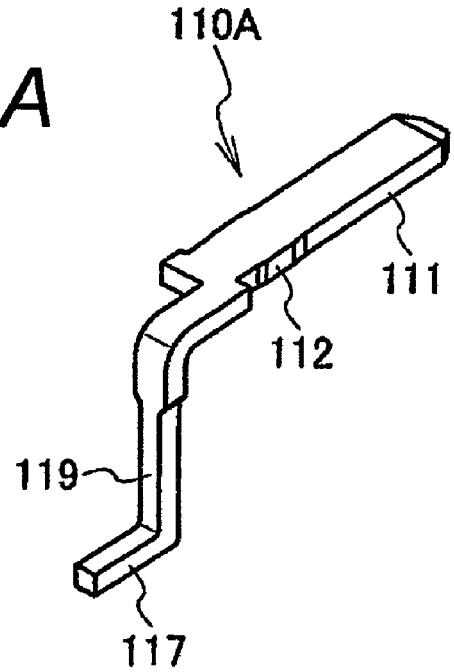
PRIOR ART FIG. 9A
FIGS. 9A and 9B are perspective views illustrating the construction of respective terminals used in the conventional circuit board connector.
Figure 9B:
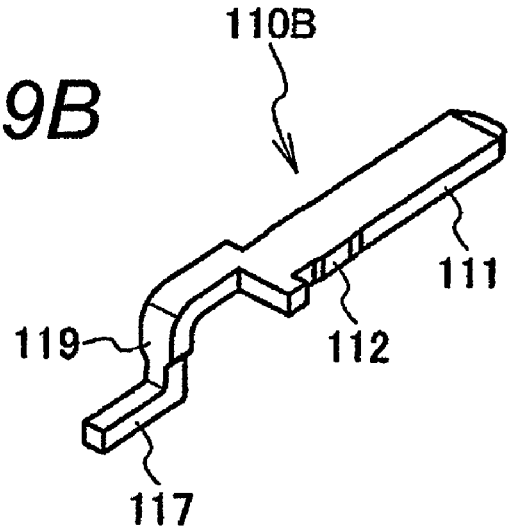

FIG. 1 is a perspective view illustrating the construction of a terminal which is used in the circuit board connector in accordance with the embodiment. FIG. 2 is an external perspective view taken from the front side of the circuit board connector in accordance with the embodiment. FIG. 3 is an external perspective view taken from the rear side of that circuit board connector. FIG. 4 is a rear view of essential portions of the circuit board connector. FIG. 5 is a partial enlarged view thereof. FIG. 6 is a horizontal cross-sectional view of that circuit board connector. FIG. 7 is a partial enlarged view thereof.

As shown in FIGS. 1 to 7, the circuit board connector in accordance with this embodiment is comprised of a resin-made connector housing 1 which is mounted on a circuit board 8 such that the front-back direction of the circuit board connector is oriented in a direction along the circuit board 8 and in which a mating connector is fitted from the front side into a fitting port 2 provided in a front portion thereof; a multiplicity of terminals 10 which are respectively press-fitted from the rear side into terminal press-fitting holes 4 formed in a rear wall 3 of the connector housing 1 and are fixed therein; and a pair of fixing brackets 7 for fixing the connector housing 1 to the circuit board 8.

As mainly shown in FIG. 1, the terminal 10 has at its front end a terminal connecting portion 11 which is disposed through the rear wall 3 of the connector housing 1 and extends therefrom toward the front side so as to be connected to the terminal on the mating connector side. Further, in the rear of the terminal connecting portion 11, the terminal 10 has a press-fitting portion 12 which is fixed to the connector housing 1 by being press-fitted in the terminal press-fitting hole 4. The press-fitting portion 12 has a convex portion 18 to be firmly fixed to the connector housing 1. Furthermore, the terminal 10 has in the rear of the press-fitting portion 12 a coupling portion 19 extending by being bent toward the circuit board 8 side and has at an end of that coupling portion 19 a board fixing portion 17 which is fixed to the circuit board 8 by soldering.

In addition, the coupling portion 19 has a first straight portion 13 extending linearly on an extension of the terminal connecting portion 11 and the press-fitting portion 12; a first bent portion 14 bent from a rear end of the first straight portion 13 toward the circuit board 8 side; a second straight portion 15 extending linearly from the first bent portion 14 toward the circuit board 8; and a second bent portion 16 bent from a lower end of the second straight portion 15 in a direction toward the front side or a direction toward the rear side parallel to the circuit board 8. The board fixing portion 17 is provided on an extension of the second bent portion 16.

Further, a square frame-shaped stress absorbing portion 20 in which a square center hole 21 is open is provided midway in the first straight portion 13 of the coupling portion 19 coupling the press-fitting portion 12 with the board fixing portion 17 of the terminal 10. In this case, the stress absorbing portion 20 is provided such that the penetrating direction of the center hole 21 is directed in the vertical direction, opposing two sides thereof are oriented substantially parallel to the front-back direction, and remaining opposing two sides thereof are oriented substantially parallel to the left-right direction. The width between outer surfaces of the opposing two sides in the left-right direction of the stress absorbing portion 20 is set to be greater than the width of the regular portion of the first straight portion 13.

In addition, as shown in FIGS. 4 to 7, a recessed portion (accommodating portion) 5 where the stress absorbing portion 20 enters is provided in the rear of the terminal press-fitting hole 4 of the connector housing 1. A clearance H for allowing the stress absorbing portion 20 to be freely deformable is secured between an inner wall of this recessed portion 5 and the stress absorbing portion 20, as shown in FIG. 5.

Next, a description will be given of the operation.

In this circuit board connector, the square frame-shaped stress absorbing portion 20 in a posture in which the penetrating direction of its center hole 21 is oriented in the vertical direction is provided in the rear of the press-fitting portion 12 of each terminal 10, i.e., midway in the first straight portion 13 of the coupling portion 19 coupling the press-fitting portion 12 with the board fixing portion 17. Therefore, even in a case where a stress has occurred between the press-fitting portion 12 and the board fixing portion 17 owing to such as a thermal contraction difference between the connector housing 1 and the circuit board 8, it is possible to absorb the stress as the square frame-shaped stress absorbing portion 20 is deformed. For example, the terminal 10 designated at reference character B in FIG. 7 shows a state before the deformation, and the terminal 10 designated at reference character A in FIG. 7 shows a state after the deformation. Since the square frame-shaped stress absorbing portion 20 as in the terminal 10 at A is deformed diagonally while maintaining the opposing two sides substantially parallel to each other, it is possible to absorb the positional offset in the left-right direction between the press-fitting portion 12 and the board fixing portion 17.

Accordingly, an undue stress ceases to be applied to the portion of the board fixing portion 17 which is soldered to the circuit board 8, and it is thereby possible to prevent in advance a crack from being formed in the soldered portion and enhance the connection reliability of the soldered portion.

In addition, since the recessed portion 5 for accommodating the stress absorbing portion 20 is provided in the rear of the terminal press-fitting hole 4 of the connector housing 1, and the clearance H is provided between this recessed portion 5 and the stress absorbing portion 20, the stress absorbing portion 20 can be freely deformed within the recessed portion 5.

It should be noted that although the frame shape of the stress absorbing portion may conceivably be formed into a triangular shape or a circular shape, the stress absorbing portion practically does not undergo deformation in the case of the triangular shape or the circular shape, so that such a shape is unsuitable in the light of stress absorption. Meanwhile, the shape of the center hole 21 is basically a similar shape to the outer shape of the stress absorbing portion 20, and if the center hole 21 is formed into another shape, the deformation becomes difficult to occur. In addition, a certain degree of effect can be expected if the width between the outer surfaces of the opposing two sides in the left-right direction of the stress absorbing portion 20 is set to be identical to the width of the first straight portion 13. However, in order to obtain a large deformation of the opposing two sides in the left-right direction, the width between the outer surfaces of the opposing two sides should preferably be set to be greater even by the slightest degree than the width of the first straight portion 13.

What is claimed is:

1. A circuit board connector, comprising:

a connector housing which is mounted on a circuit board and is provided with a fitting port for fitting a mating connector at a front side and a terminal press-fitting hole at a rear side; and a terminal which is press-fitted into and fixed to the terminal press-fitting hole and which includes:

a terminal connecting portion which is disposed through the rear side of the connector housing and extends therefrom toward the front side so as to be connected to a terminal of the mating connector;

a press-fitting portion which is continuous from the terminal connecting portion to be fixed to the connector housing by being press-fitted in the terminal press-fitting hole;

a board fixing portion which is fixed to the circuit board by soldering;

a coupling portion which extends and is bent toward a side of the circuit board to couple the press-fitting portion with the board fixing portion, and a stress absorbing portion formed of a square frame shape and provided with a center hole which is provided on a midway of the coupling portion so as to absorb a stress by being deformed;

wherein the coupling portion includes:

a first straight portion extending linearly on an extension of the terminal connecting portion and the press-fitting portion;

a first bent portion bent from a rear end of the first straight portion toward the side of the circuit board;

a second straight portion extending linearly from the first bent portion toward the circuit board; and a second bent portion bent from a lower end of the second straight portion in a direction toward the front side or a direction toward the rear side parallel to the circuit board, the board fixing portion being provided on an extension of the second bent portion, and wherein the stress absorbing portion is provided midway in the first straight portion such that a penetrating direction of the center hole is directed in a vertical direction, first opposing two sides thereof are oriented substantially parallel to a front-back direction, and remaining second opposing two sides thereof are oriented substantially parallel to a left-right direction.

2. The circuit board connector according to claim 1, wherein an outer width between the second opposing two sides of the stress absorbing portion is made greater than a width of the first straight portion.

3. The circuit board connector according to claim 1, wherein an inner width between the second opposing two sides of the stress absorbing portion is made greater than a width of the first straight portion.

4. A circuit board connector, comprising:

a connector housing which is mounted on a circuit board and is provided with a fitting port for fitting a mating connector at a front side and a terminal press-fitting hole at a rear side; and a terminal which is press-fitted into and fixed to the terminal press-fitting hole and which includes:

a terminal connecting portion which is disposed through the rear side of the connector housing and extends therefrom toward the front side so as to be connected to a terminal of the mating connector;

a press-fitting portion which is continuous from the terminal connecting portion to be fixed to the connector housing by being press-fitted in the terminal press-fitting hole;

a board fixing portion which is fixed to the circuit board by soldering;

a coupling portion which extends and is bent toward a side of the circuit board to couple the press-fitting portion with the board fixing portion, and a stress absorbing portion provided with a center hole which is provided on a midway of the coupling portion so as to absorb a stress by being deformed;

wherein an accommodating portion for accommodating the stress absorbing portion is provided in the rear of the terminal press-fitting hole of the connector housing, such that a clearance is provided between the accommodating portion and the stress absorbing portion.

* * * * *